US007426997B2

(12) United States Patent
Nagelski

(10) Patent No.: US 7,426,997 B2
(45) Date of Patent: Sep. 23, 2008

(54) MERCHANDISE DISPLAY HOOK

(75) Inventor: Keith C. Nagelski, Huntersville, NC (US)

(73) Assignee: InVue Security Products Inc, Charlotte, NC (US)

( * ) Notice: Subject to any disclaimer, the term of this patent is extended or adjusted under 35 U.S.C. 154(b) by 187 days.

(21) Appl. No.: 11/404,066

(22) Filed: Apr. 13, 2006

(65) Prior Publication Data

US 2007/0241069 A1 Oct. 18, 2007

(51) Int. Cl.
*A47F 5/08* (2006.01)

(52) U.S. Cl. ..... 211/57.1

(58) Field of Classification Search ..... 211/57.1, 211/59.1, 86.01, 54.1; 248/221.11, 229.22, 248/220.31, 220.21, 222.52
See application file for complete search history.

(56) References Cited

U.S. PATENT DOCUMENTS

| | | | | | |
|---|---|---|---|---|---|
| 2,987,286 | A * | 6/1961 | Alling | ..... | 248/220.31 |
| 3,275,272 | A * | 9/1966 | Kirk | ..... | 248/220.41 |
| 3,289,993 | A | 12/1966 | Thalenfeld | | |
| 3,409,260 | A | 11/1968 | Bleed | | |
| 4,146,204 | A | 3/1979 | Thalenfeld | | |
| 4,351,440 | A | 9/1982 | Thalenfeld | | |
| 4,362,249 | A | 12/1982 | Thalenfeld | | |
| 4,436,209 | A | 3/1984 | Thalenfeld | | |
| 4,474,351 | A | 10/1984 | Thalenfeld | | |
| 4,512,481 | A | 4/1985 | Thalenfeld | | |
| 4,520,978 | A | 6/1985 | Taub | | |
| 4,674,721 | A | 6/1987 | Thalenfeld | | |
| 4,718,626 | A | 1/1988 | Thalenfeld et al. | | |
| 5,769,373 | A * | 6/1998 | Bond | ..... | 248/220.41 |
| 5,815,970 | A | 10/1998 | Thalenfeld et al. | | |
| 6,601,808 | B1 | 8/2003 | Nagel | | |
| 6,957,555 | B1 * | 10/2005 | Nagel et al. | ..... | 70/57.1 |

* cited by examiner

*Primary Examiner*—Sarah Purol
(74) *Attorney, Agent, or Firm*—Sand & Sebolt

(57) ABSTRACT

A merchandise display hook for mounting on a display structure includes a one-piece elongated U-shaped rigid member having a pair of spaced parallel rods and a connecting base. A sleeve is secured to the base and telescopically receives a shaft therethrough forming a pivot. A pair of lugs are fixed to outer ends of the shaft and have L-shaped ends which extend through openings in the display structure. Downward movement of the base along the support structure while the rods remain in a horizontal position pivotally move the lugs through and behind the support structure to a securely mounted position on the support structure eliminating the need for any upward angled movement of the display hook to install the hook, enabling the hook to be installed in a confined area.

15 Claims, 3 Drawing Sheets

MERCHANDISE DISPLAY HOOK

BACKGROUND OF THE INVENTION

1. Technical Field

The invention relates to merchandise display hooks, and particularly to a hook which is adapted to be mounted on a support surface such as a pegboard, by a straight-in direction enabling it to be installed and removed in confined places.

2. Background Information

Various types of merchandise display hooks have been developed for use with supporting structures such as a pegboard, slat-wall, wire grid, etc. having a plurality of spaced openings or supporting wires, in which one or more lugs on the hook are inserted for retaining one or more elongated rigid rods in a generally horizontal direction, in a cantilever manner, outwardly from the support structure. However, one problem that exists with such types of display hooks is that in order to install the hook in the support structure, the hook must be placed at a severe upward angle such as 45° or greater, for insertion of the attachment lugs into the openings of the support structure, afterwhich the hook is pivoted downwardly enabling the lugs to position themselves behind the support structure upon the elongated rods reaching a horizontal position. Removal of the display hook is accomplished in the reverse direction, again requiring the elongated rods to be pivoted upwardly in order to remove the attachment lugs from the support structure openings. This becomes a problem where there is a structure or other merchandise closely spaced above or below the intended location of the display hook. This prevents the display hook from being installed at the desired location since it requires a sufficient spacing beneath the other display hook, supported merchandise, adjacent shelf or other obstruction, for mounting of the new display hook spaced only a slight distance below the structure above.

Various types of display hooks have been developed in order to eliminate this problem by providing a straight-in type mounting arrangement for the display hook, such as shown in U.S. Pat. Nos. 4,351,440 and 5,769,373. Although the display hooks of these patents may provide a desired solution, the present invention accomplishes this result in a relatively simple, inexpensive and efficient manner. The hook of the present invention enables it to be mounted in the spaced openings of a support structure while the elongated rod or rods are maintained in a horizontal position requiring only the pivotal movement of the support lugs and slight vertical movement of the support hook along the face of the support structure for installing and removing the display hook.

Therefore, the need exists for an improved merchandise display hook which can be mounted in a straight-in fashion on a support structure such as a sheet of pegboard, slat-wall, wire grid etc. enabling the display hook to be used in a confined area amongst other display hooks or other obstructions since it avoids the need of placing the elongated rods of the display hook at an angle as heretofore required to secure the attachment lugs in the openings of the support structure.

BRIEF SUMMARY OF THE INVENTION

One aspect of the present invention is to provide a merchandise display hook which includes one or more elongated rigid rods for supporting and protecting a plurality of items of merchandise, which is provided with one or more attachment lugs which are pivotally mounted with respect to the rods enabling the display hook to be attached in a straight-in manner without requiring angular movement of the rod since only the attachment lugs are pivotally moved as the rods move a very short distance vertically along the face of the support structure.

Still another feature of the invention is to provide such a merchandise display hook which can be formed of a one-piece elongated U-shaped member providing a pair of support and protecting rods having a pivot mechanism consisting of a sleeve fixed to a base of the U-shaped member for slidably receiving a pivot shaft therein, with the attachment lugs being fixed on the ends of the pivotally mounted shaft.

Another feature of the present invention is to enable the display hook to be removed easily from a support structure by a slight vertical upward movement of the elongated rods while the rods remain in a horizontal position enabling the attachment lugs to be pivoted out of engagement with the support structure openings, afterwhich the display hook can be moved horizontally away from the support structure without disturbing any of the surrounding merchandise and/or adjacent obstructions above or below.

Still another feature is to provide such a merchandise display hook in which the attachment lugs occupy relatively limited space and are of a simple construction than prior art display hooks achieving the same result but with more complicated, expensive and cumbersome lug attachment structures.

Another aspect of the invention is to enable the display hook to be used in conjunction with a lock housing which locks the display hook to the support structure, and with a thief prevention device secured to the outer distal end of the display hook.

These features and aspects are obtained by the merchandise display hook of the present invention, the general nature of which may be stated as comprising a merchandise support rod having a base extending generally perpendicular to the rod, wherein the base is adapted to engage a support structure when in an installed position to maintain the rod in a substantially horizontally outwardly extending position generally perpendicular to the support structure; a sleeve fixed on the base and extending generally perpendicular to the rod and base; a shaft extending through the sleeve for pivotally mounting said shaft with respect to the sleeve and rod; and a pair of mounting lugs fixed on opposed ends of the shaft for inserting into openings on the support structure whereby the rod can maintain a generally perpendicular relationship with the support structure as the lugs are inserted into the support openings and pivoted to a fixed position with the support structure when in the installed position.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
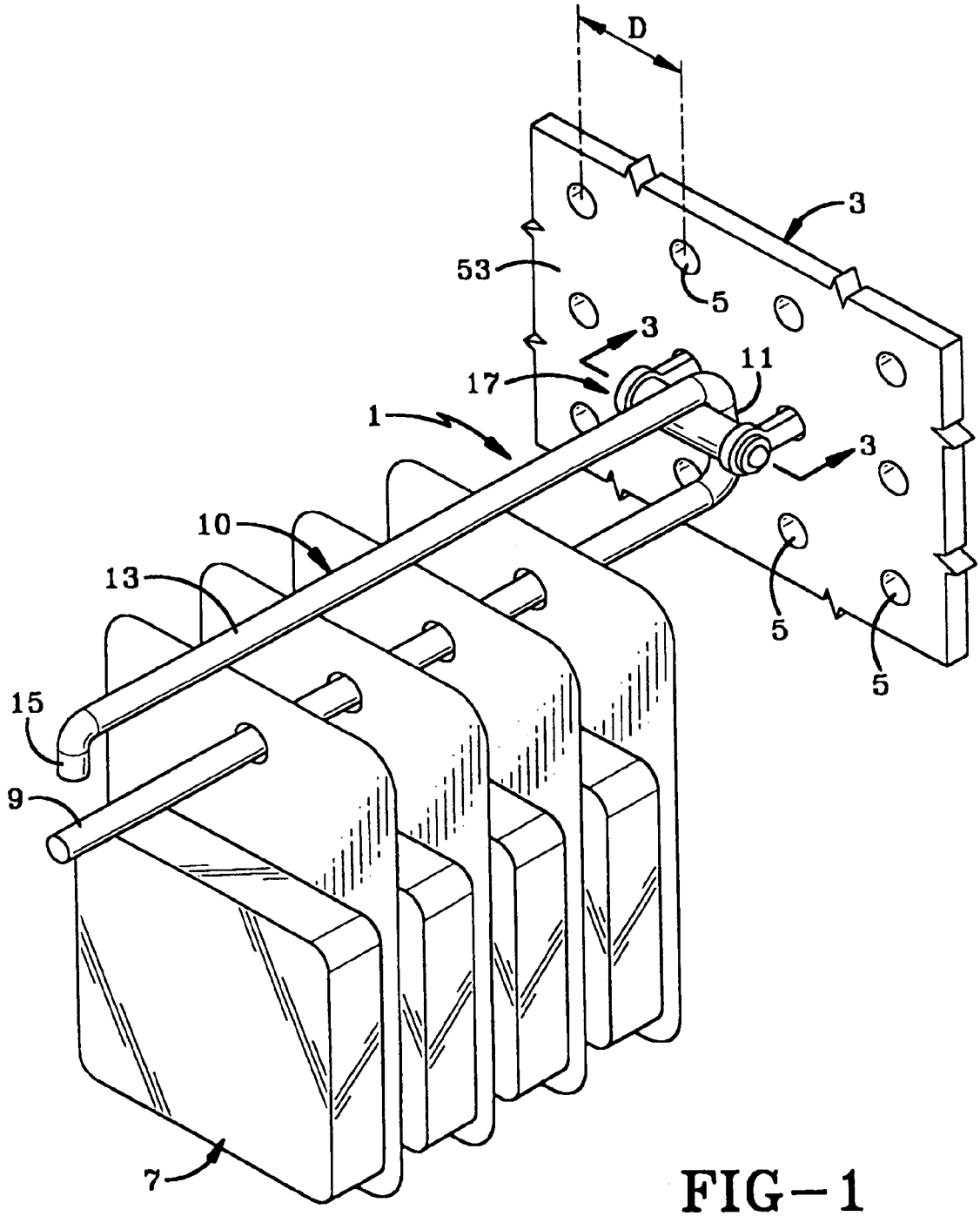
FIG. 1 is a diagrammatic perspective view showing the improved merchandise display hook of the present invention mounted on a display panel and supporting a plurality of items of merchandise.

The improved merchandise display hook of the present invention is indicated generally at 1, and is shown in FIG. 1 mounted on a support panel 3. Panel 3 is formed with a plurality of holes or apertures 5, such as in a usual type of pegboard used for the displaying of items of merchandise 7, a plurality of which are shown mounted on display hook 1. However, it is readily understood that support panel 3 can be various types of structures, for example, a slat-wall, wire grid etc. without effecting the invention. Display hook 1 includes at least one elongated rigid rod 9 formed of metal or plastic, preferably having a circular cross section which includes a base 11 that extends generally perpendicular with respect to the longitudinal axis of rod 9. Preferably, display hook 1 will include a second elongated rod 13 which is spaced from and extends parallel with merchandise support rod 9. Rod 13 may terminate in a bent end 15 which assists in maintaining the merchandise on rod 9 and reduces the possibility of a thief sweeping the entire row of merchandise from display rod 9 in a single motion. This arrangement provides a single one-piece member 10 comprising spaced rods 9 and 13 and base 11 which is the web of the elongated U-shaped member.

Figure 6:
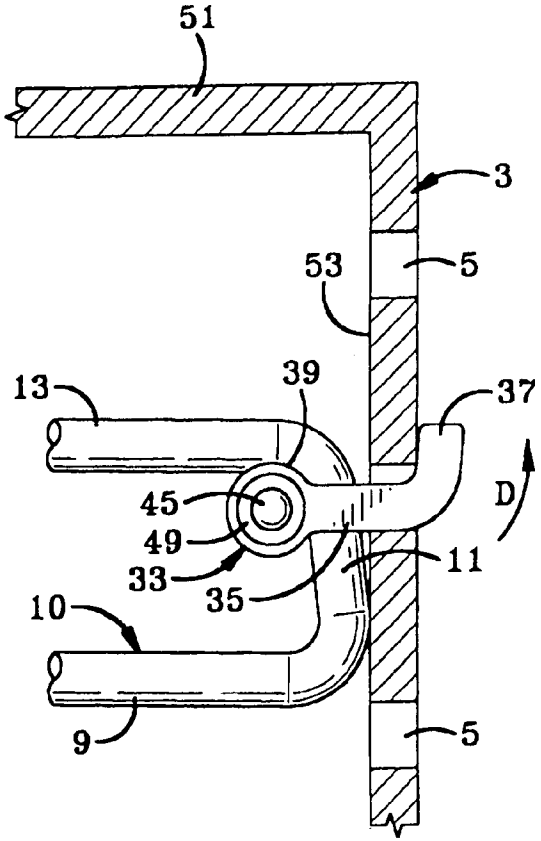
FIG. 6 is a view similar to FIGS. 4 and 5 showing the final step and location of the display hook on the display panel.
Figure 5:
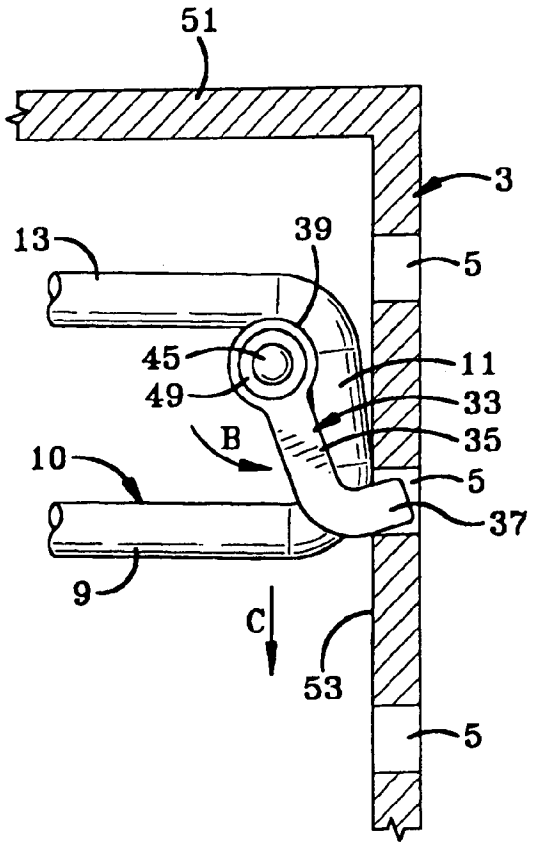
FIG. 5 is a view similar to FIG. 4 showing the mounting lugs of the display hook being inserted into the openings of the display panel.
Figure 4:
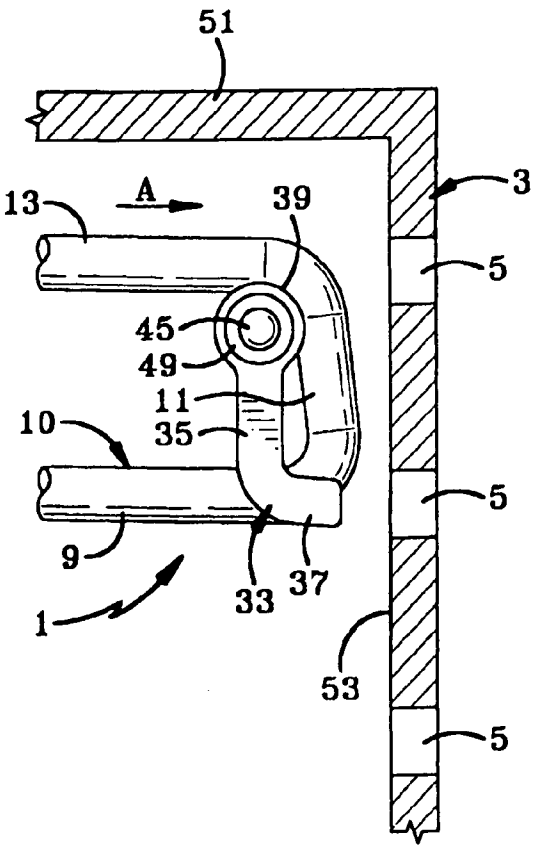
FIG. 4 is a diagrammatic view with portions in section showing the initial step of installing the merchandise display hook on a display panel.

In accordance with the main feature of the invention, a pivot assembly indicated generally at 17, includes a pivot sleeve 18 which is mounted on U-shaped member 10, preferably by one or more welds 19 securing it within an upper corner 21 between top rod 13 and base 11. However, sleeve 18 would also be secured by welds or other attachment means directly to base 11 or to base 11 and rod 9 in a lower corner 23 thereof, without departing from the concept of the present invention. As best shown in FIGS. 4-6, upper and lower corners 21 and 23 are generally right angle corners. However, in the preferred embodiment, upper corner 21 preferably is slightly greater than a right angle with lower corner 23 being slightly less in order to facilitate the mounting and removal of display hook 1 on support panel 3.

Figure 3:
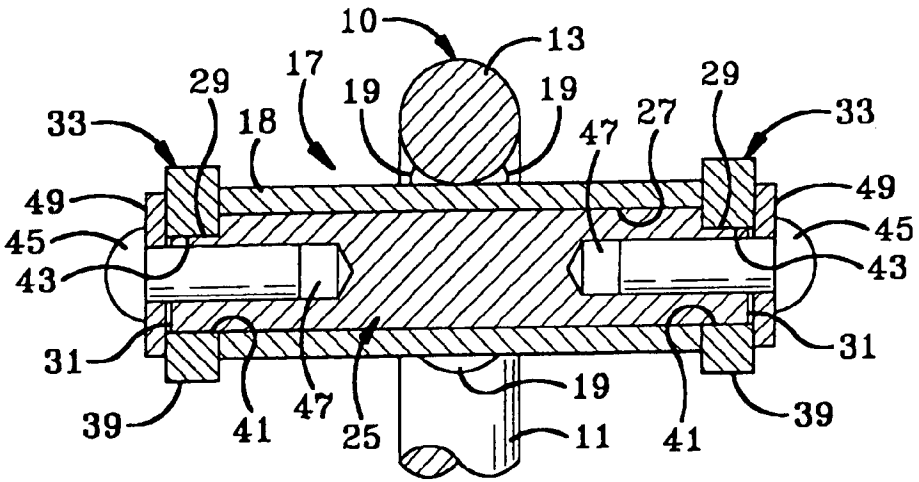
FIG. 3 is an enlarged sectional view taken on line 3-3, FIG. 1.
Figure 2:
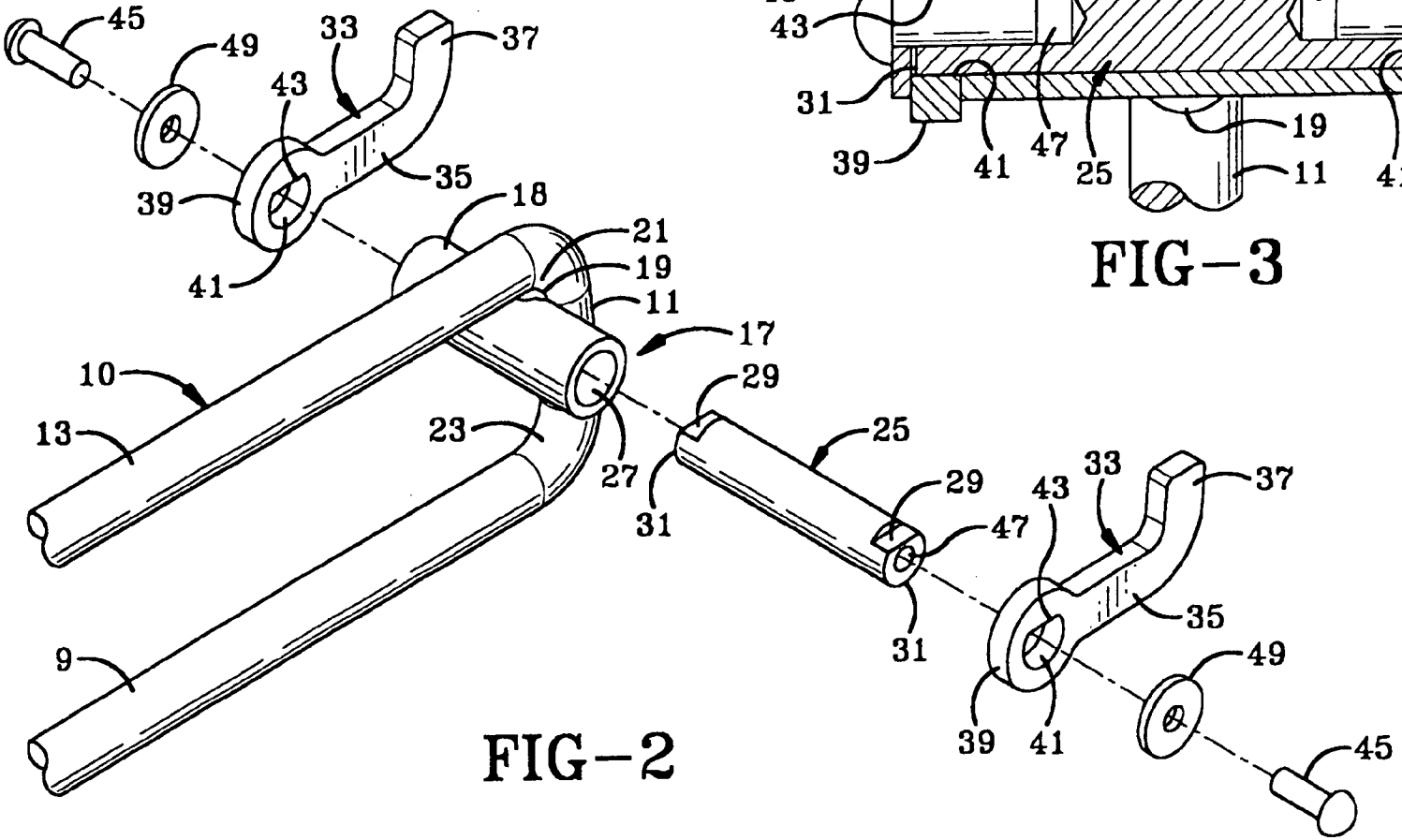
FIG. 2 is a fragmentary exploded perspective view of the merchandise display hook of the present invention.

Pivot assembly 17 (FIGS. 2 and 3) further includes a cylindrical pivot shaft 25 which is slidably telescopically received and freely rotatably mounted within the hollow interior 27 of sleeve 18. Pivot shaft 25 includes a pair of flat surfaces 29 adjacent opposed ends 31 thereof to assist in securely mounting and fixing a pair of support lugs 33 thereon. Lugs 33 preferably are stamped of a rigid metal, although they could be formed of plastic or similar material, and have a generally L-shaped configuration with a first leg 35 and an end leg 37 with a generally circular end 39 formed with an opening 41. Opening 41 is formed with a flat surface 43 which mates with flat surfaces 29 of shaft 25 to prevent rotation of support lugs 33 with respect to shaft 25. A rivet 45 or other type of fastener extends into end openings 47 of shaft ends 31 to secure lugs 33 on the shaft ends. A washer 49 preferably is located between the head of rivet 45 and a side surface of each lug 33. Thus, as can be seen particularly in FIGS. 2 and 3, the merchandise display hook and in particular pivot assembly 17, is of a relatively simple, inexpensive structure which occupies a relatively small space. The length of shaft 25 is chosen so that the spacing between lugs 33 equals the distance D horizontally between a pair of support panel openings 5 as shown in FIG. 1, which spacing is standard for many types of pegboards. The length of shaft 25 can be easily adjusted enabling display hook 1 to be used with other types of supporting structures having different spaces between the mounting holes 5 shown in FIG. 1.

The particular manner of use of display hook 1 is shown in FIGS. 4-6. As shown in FIG. 4, hook 1 is moved in a generally horizontal straight-in direction as shown by Arrow A, enabling it to be located closely below an upper obstruction 51, such as a shelf or other displayed items. Upon reaching display support panel 3, lugs 33 are merely rotated manually from their downward hanging vertical position of FIG. 4, so that ends 37 thereof extend through selected openings 5 as shown in FIG. 5, in the direction of Arrow B. Slight downward vertical movement of U-shaped member 18 in the direction of Arrow C (FIG. 5), will cause lugs 33 and particularly ends 37 thereof, to move through openings 5 to their secured mounting position behind panel 3 as shown in FIG. 6, placing U-shaped member 10 in its final support position. In this position rods 9 and 13 extend in a generally horizontal direction supported by the engagement of base 11 with the front surface 53 of panel 3 as shown in FIG. 6. As illustrated in FIGS. 4-6, no angled movement of rods 9 and 13 is required as in prior display hooks, for securing the hook on the support structure.

Display hook 1 is removed easily in a straight-out manner by reversing the procedure discussed above by merely moving U-shaped member 10 slightly vertically upwardly in an opposite direction to that of Arrow C. This movement will pivotally move lugs 33 from their installed position of FIG. 6 to that of FIG. 5 enabling the display hook to be moved horizontally in a straight-out direction opposite to that of Arrow A as shown in FIG. 4. As can be seen in FIG. 4, display hook 1 can be installed in a very small space below an upper obstruction whether it be a shelf, bracket, additional display items, etc. requiring only a slight vertical movement of member 10 as shown from the position of the display hook of FIG. 4 to that of FIG. 6. This also enables display hook 1 to be mounted closely adjacent a lower obstruction (not shown) if necessary, or enables another display hook 1 to be mounted directly below an upper display hook 1 requiring very little space therebetween, sufficient only to avoid the particular type of merchandise 7 supported on lower rod 9.

In summary, display hook 1 provides a relatively simple, inexpensive device, formed of a rigid metal or rigid plastic material or combination thereof, which device is free of separate parts that could be displaced and lost, in which the pivot assembly which enables the straight-in placement and removal of display hook 1 from display panel 3 occupies minimum space, and which enables base 11 or the web of U-shaped member 18, to provide the abutting engagement with panel 3.

It is readily understood that lugs 33 need not be L-shaped as shown in the drawings and described above, but could have various configurations including a straight linear shape which would extend into a longer extending opening in a thicker support structure, such as directly into a wall or other support structure, not requiring access to an opposite side surface thereof as shown in FIG. 6.

In accordance with the invention, display hook 1 preferably will be used, but not required, with a lock housing (not shown) to secure the display hook to a supporting structure. Also an anti-theft device (not shown) can be secured to the distal end of the display hook 1 if desired to increase the security aspects of the invention. Examples of such lock housings and anti-theft devices are shown in pending U.S. patent application Ser. No. 10/800,346, filed Mar. 12, 2004.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A merchandise display hook for mounting on a support structure comprising:

a merchandise support rod having a base extending generally perpendicular to said rod, said base adapted to engage the support structure when in an installed position to maintain the rod in a substantially horizontally outwardly extending position generally perpendicular to the support structure;

a sleeve fixed on the base and extending generally perpendicular to the rod and base;

a shaft extending through the sleeve pivotally mounting said shaft with respect to the sleeve and rod;

a pair of mounting lugs fixed on opposed ends of the shaft for inserting into openings on the support structure whereby the rod can maintain a generally horizontal position as the lugs are inserted into the support openings and pivoted to a fixed installed position with the support structure; and a fastener fixing at least one of the lugs to one of the shaft ends.

2. The display hook defined in claim 1 wherein the merchandise support rod is one component of an elongated U-shaped member having a second rod spaced from and parallel to said merchandise support rod, said rods extending outwardly from opposed ends of the base which forms a web of the U-shaped member.

3. The display hook defined in claim 2 wherein the U-shaped member is a one-piece member formed of a rigid metal or plastic material having a generally circular cross section.

4. The display hook defined in claim 1 wherein both of the pair of lugs are fixed to the opposed ends of the shaft by fasteners.

5. The display hook defined in claim 4 wherein a washer is located between each of the lugs and the fasteners.

6. The display hook defined in claim 1 wherein the opposed ends of the shaft each have a flat surface; and in which each of the lugs have an opening formed with a flat surface which mates with the flat surfaces of the shaft ends to fix the lugs on said shaft ends.

7. The display hook defined in claim 1 wherein each of the lugs have a generally L-shape with a first leg having an end opening for receiving an end of the shaft therein and a second leg extending generally perpendicular to said first leg and adapted to extend through the support structure openings.

8. In combination a support structure having mounting openings and a merchandise display hook removably mounted on the support structure, wherein the display hook comprises a merchandise supporting rigid elongated rod extending substantially horizontally perpendicularly outwardly from the support structure, a second rod extending generally parallel with and spaced above the merchandise supporting rod, and a vertically extending base extending between the rods and forming a web of a U-shaped member, said base abutting the support structure maintaining the elongated rod horizontally, a sleeved fixed on the base of the U-shaped member and pivotally mounting the shaft therein; said display hook further including a pair of lugs fixedly mounted on opposed ends of the shaft and pivotally mounted on the base and insertable through the support structure openings as the base moves downwardly along the support structure with the elongated rod remaining substantially horizontal relative to said structure, at least one of the lugs having an opening formed with a flat surface which mates with a flat surface formed on one of the shaft ends to fix said one lug on the shaft end.

9. The combination defined in claim 8 wherein the merchandise support rod and second rod form generally right angle corners with the base; and in which the sleeve is secured to the display hook with one of said corners.

10. The combination defined in claim 9 wherein the sleeve is secured By a weld within the corner formed between the second rod and base of the display hook.

11. The combination defined in claim 8 wherein the sleeve, shaft, lugs and pair of rods are formed of metal.

12. The combination defined in claim 8 wherein each of the lugs have a generally L-shape with a first leg having an opening receiving and end of the shaft therein and a second leg extending generally perpendicular to said first leg and adapted to extend through the support structure openings.

13. A merchandise display hook for mounting on a support structure comprising:

a merchandise support rod having a base extending generally perpendicular to said rod, said base adapted to engage the support structure when in an installed position to maintain the rod in a substantially horizontally outwardly extending position generally perpendicular to the support structure;

a sleeve fixed on the base and extending generally perpendicular to the rod and base;

a shaft having a pair of opposed ends with flat surfaces thereon, said shafts extending through the sleeve pivotally mounting the shaft with respect to the sleeve and rod;

a pair of mounting lugs, each lug having an opening formed with a flat surface which mates with the flat surface of the shaft ends to fix the lugs on the shaft ends, said lugs being insertable into openings on the support structure whereby the rod can maintain a generally horizontal position as the lugs are inserted into the support openings and pivoted to a fixed installed position with the support structure.

14. A merchandise display hook for mounting on a support structure comprising:

a merchandise support rod having a base extending generally perpendicular to said rod, said base adapted to engage the support structure when in an installed position to maintain the rod in a substantially horizontally outwardly extending position generally perpendicular to the support structure;

a sleeve fixed on the base and extending generally perpendicular to the rod and base;

a shaft extending through the sleeve pivotally mounting said shaft with respect to the sleeve and rod; and a pair of mounting lugs fixed on opposed ends of the shaft for inserting into openings on the support structure whereby the rod can maintain a generally horizontal position as the lugs are inserted into the support openings and pivoted to a fixed installed position with the support structure, each of said lugs having a generally L-shape with a first leg having an end opening for receiving an end of the shaft therein and a second leg extending generally perpendicular to said first leg and adapted to extend through the support structure openings.

15. In combination a support structure having mounting openings and a merchandise display hook removably mounted on the support structure, wherein the display hook comprises an elongated one-piece U-shaped member having a merchandise supporting rigid elongated first rod extending substantially horizontally perpendicularly outwardly from the support structure and an elongated second rod extending generally parallel with and spaced above the merchandise supporting first rod, and a base extending vertically between the rods and forming the web of the U-shaped member and abutting the support structure for maintaining the first and second elongated rods horizontally; a sleeve fixed on the base of the U-shaped member and pivotally mounting a shaft therein; a pair of lugs fixedly mounted on opposed ends of the shaft and pivotally mounted on the base and insertable through the support structure openings as the base moves downwardly along the support structure with the elongated rods remaining substantially horizontal to said structure; each of the lugs having a generally L-shape with a first leg having an end opening receiving an end of the shaft therein and a second leg extending generally perpendicular to said first leg and adapted to extend through the support structure openings.

* * * * *